US007916875B2

(12) United States Patent
Kanji

(10) Patent No.: US 7,916,875 B2
(45) Date of Patent: Mar. 29, 2011

(54) AUDIO INPUT-OUTPUT MODULE, PLUG-IN DEVICE DETECTION MODULE AND METHODS FOR USE THEREWITH

(75) Inventor: Ajaykumar Kanji, Austin, TX (US)

(73) Assignee: Integrated Device Technology, Inc., San Jose, CA (US)

( * ) Notice: Subject to any disclaimer, the term of this patent is extended or adjusted under 35 U.S.C. 154(b) by 1490 days.

(21) Appl. No.: 11/304,311

(22) Filed: Dec. 14, 2005

(65) Prior Publication Data

US 2007/0133829 A1 Jun. 14, 2007

(51) Int. Cl.
*H04R 29/00* (2006.01)

(52) U.S. Cl. ..... 381/58; 700/94

(58) Field of Classification Search ..... 381/123, 381/74, 111, 11, 12, 58, 59, 80, 85; 700/94; 439/668, 669; 370/241
See application file for complete search history.

(56) References Cited

U.S. PATENT DOCUMENTS

| | | | | |
|---|---|---|---|---|
| 6,970,752 | B1 * | 11/2005 | Lim et al. | 700/94 |
| 7,038,499 | B1 * | 5/2006 | Toosky | 327/78 |
| 7,167,569 | B1 * | 1/2007 | Seven | 381/111 |
| 2004/0081099 | A1 * | 4/2004 | Patterson et al. | 370/241 |

* cited by examiner

*Primary Examiner* — Vivian Chin
*Assistant Examiner* — Lun-See Lao
(74) *Attorney, Agent, or Firm* — Garlick, et al.

(57) ABSTRACT

A plug-in device detection module includes a measurement signal generator for generating a measurement signal. A port coupler couples the measurement signal to a selected plug-in receptor of a plurality of plug-in receptors, generates an input/output signal and generates a port signal in response to the measurement signal. A reference signal generator generates a reference signal based on the input/output signal, the reference signal having a plurality of reference signal values. A detection module detects a plug-in device type of a plug-in device coupled to the selected plug-in receptor, based on the reference signal and the port signal.

41 Claims, 14 Drawing Sheets

AUDIO INPUT-OUTPUT MODULE, PLUG-IN DEVICE DETECTION MODULE AND METHODS FOR USE THEREWITH

CROSS REFERENCE TO RELATED PATENTS

The present application is related to the following U.S. patent applications that are commonly assigned:

Audio input-output module, plug-in detection module and methods for use therewith, having Ser. No. 11/304,310 filed on Dec. 14, 2005;

the contents of which are expressly incorporated herein in their entirety by reference thereto.

BACKGROUND OF THE INVENTION

1. Technical Field of the Invention

The present invention relates to audio input-output modules as may be used in audio codecs, computers and related methods.

2. Description of Related Art

As is known, audio signals are processed by a wide variety of electronic equipment, including portable, or handheld, devices. Such devices include laptop, notebook and other personal computers, personal digital assistants (PDA), CD players, MP3 players, DVD players, AM/FM radio, satellite radio systems, in-band on channel digital radios, cellular telephones, consumer audio equipment such as stereo systems, home theater systems, cable and satellite tuners and set-top boxes, digital video recorders and other systems that support the processing of audio and video, etc. Each of these devices includes one or more integrated circuits to provide the functionality of the device. As an example, a computer may include an audio codec or other audio input-output module to support the processing of audio signals in order to produce an audio output that is delivered to the user through speakers, headphones or the like and/or to receive audio signals from an external device such as a microphone, CD player or other source of analog or digital audio signals.

A problem common to many of these devices is that many are equipped with multiple jacks for coupling signals such as audio input/output signals to and from the device. A user of the device may connect or disconnect these jacks while the device is in operation, either to discontinue the use of a connection or to couple a new peripheral or signal to the device. It is desirable to detect that a device or signal has been coupled to or decoupled from each of the plurality of jacks, and for detecting the type of device that is coupled to each of the plurality of jacks, in a manner that can be efficiently implemented in an electronic device.

DETAILED DESCRIPTION OF THE INVENTION INCLUDING THE PRESENTLY PREFERRED EMBODIMENTS

Figure 1:
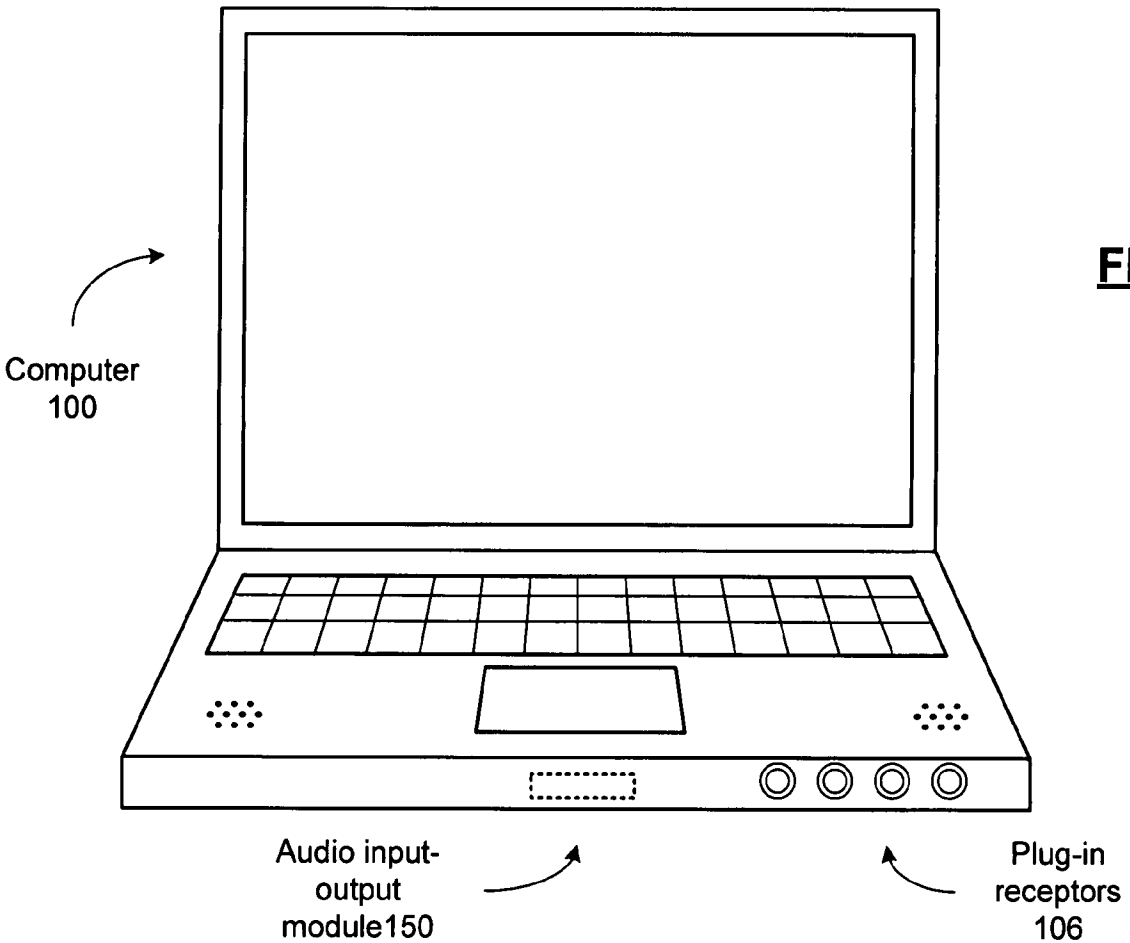
FIG. 1 presents a pictorial view of a computer in accordance with an embodiment of the present invention.

FIG. 1 presents a pictorial view of a computer in accordance with an embodiment of the present invention. In particular, computer 100 includes audio input-output module 150 for receiving audio signals, such as music, speech signals, audio tracks of movies or other signals, from an external device coupled through one or more of the plug-in receptors 106. In addition, audio input-output module is operable to provide one or more signals for coupling an audio output signal to external audio output devices such as speakers, stereo systems, headphones, ear buds, through one or more plug-in receptors 106.

Audio input-output module 150 is capable of detecting the type of device that is coupled to each of a plurality of plug receptors including various features and functions in accordance with the present invention that will be described in conjunction with the figures that follow.

Figure 2:
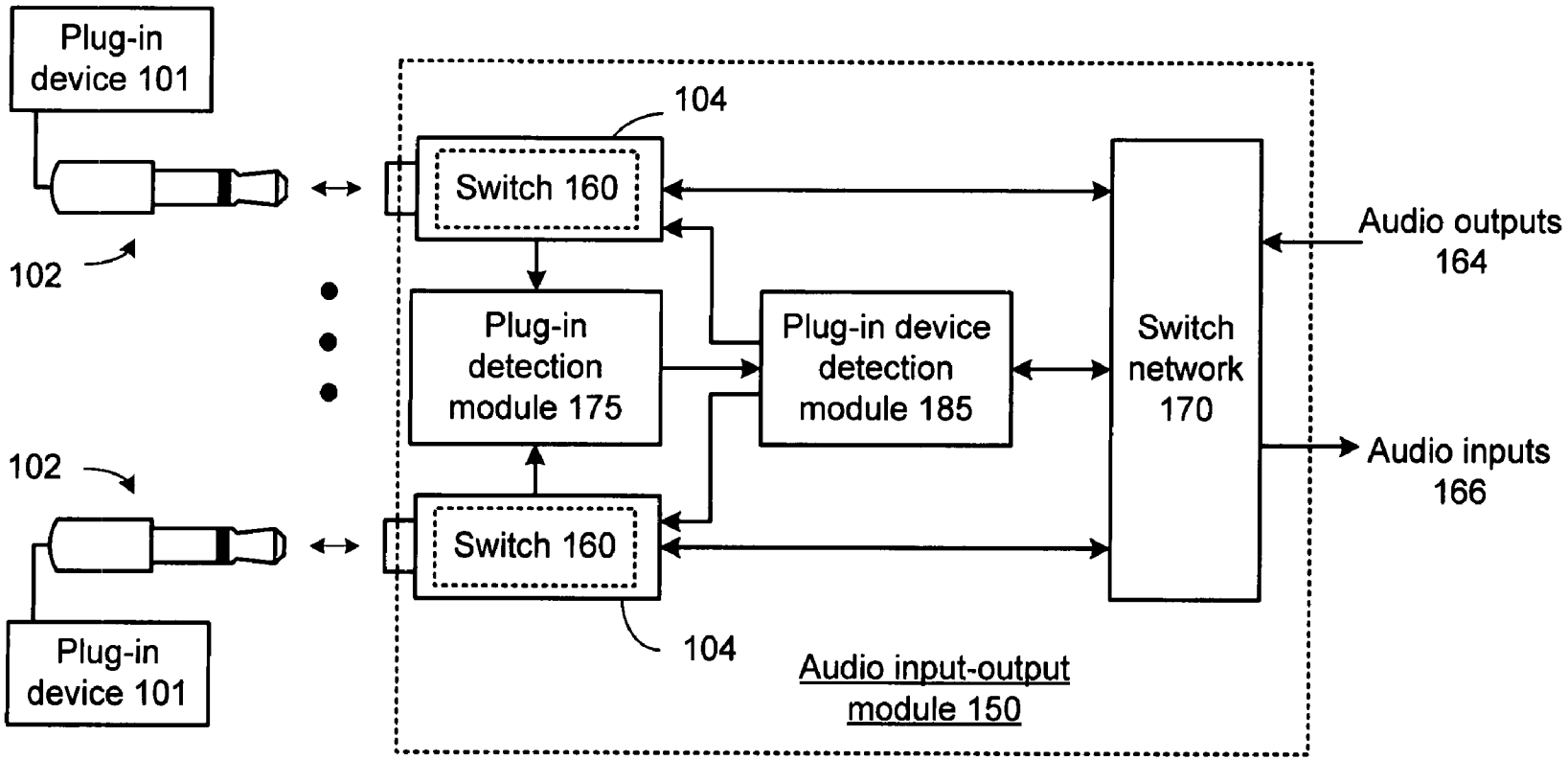
FIG. 2 presents a pictorial/block diagram representation of an audio output driver 150 in accordance with an embodiment of the present invention.

FIG. 2 presents a pictorial/block diagram representation of an audio input-output module 150 in accordance with an embodiment of the present invention. In particular, audio input-output module 150 includes a plurality of plug-in receptors 104 for coupling to a plurality of plug connectors 102 of corresponding plug-in devices 101. In an embodiment of the present invention, the plug connectors can be the same for each plug-in receptor 104 or different plug connector/plug-in receptor combinations can be used. The plug-in receptors 104 can be of the male or female, monaural or stereo varieties. The plug-in receptors 104 can be implemented in a standard configuration such as a ¼" phone connector, miniature or subminiature phone connector, RCA phone connector, 8-pin ham microphone connector, coaxial connector of N size, H size or other size, an S-video connector, a banana jack connector, a PL-259 connector, an F connector, a BNC connector or other plug or jack connector, either standard or non-standard that can be coupled and decoupled.

Each of the plurality of plug-in receptors 104 has a corresponding switch 160 that has a first state when coupled to a plug connector and a second state when plug-in receptor is decoupled from a plug connector. Audio input-output module 150 further includes plug-in detection module 175 for detecting that a plug-in connector 102 has been recently coupled to a selected plug-in receptor 104 of the plurality of plug-in receptors.

A plug-in device detection module 185 is operably coupled to the plurality of plug-in receptors 104 and the plug-in detection module 175 for detecting a plug-in device type of a plug-in device 101 coupled to the one of the plurality of plug-in receptors 104. Switch network 170 selectively couples one of a number of audio outputs 164 or selectively coupling one of a number of audio inputs 166 to the one of the plurality of plug-in receptors 104, based on the detected plug-in device type. While audio inputs and outputs are specifically shown, the present invention may likewise couple video input and output signals, with or without one or more channels of corresponding audio.

These and other functions and features of the invention will be discussed further, including additional embodiments and implementations of the present invention in association with FIGS. 3-9 that follow.

Figure 3:
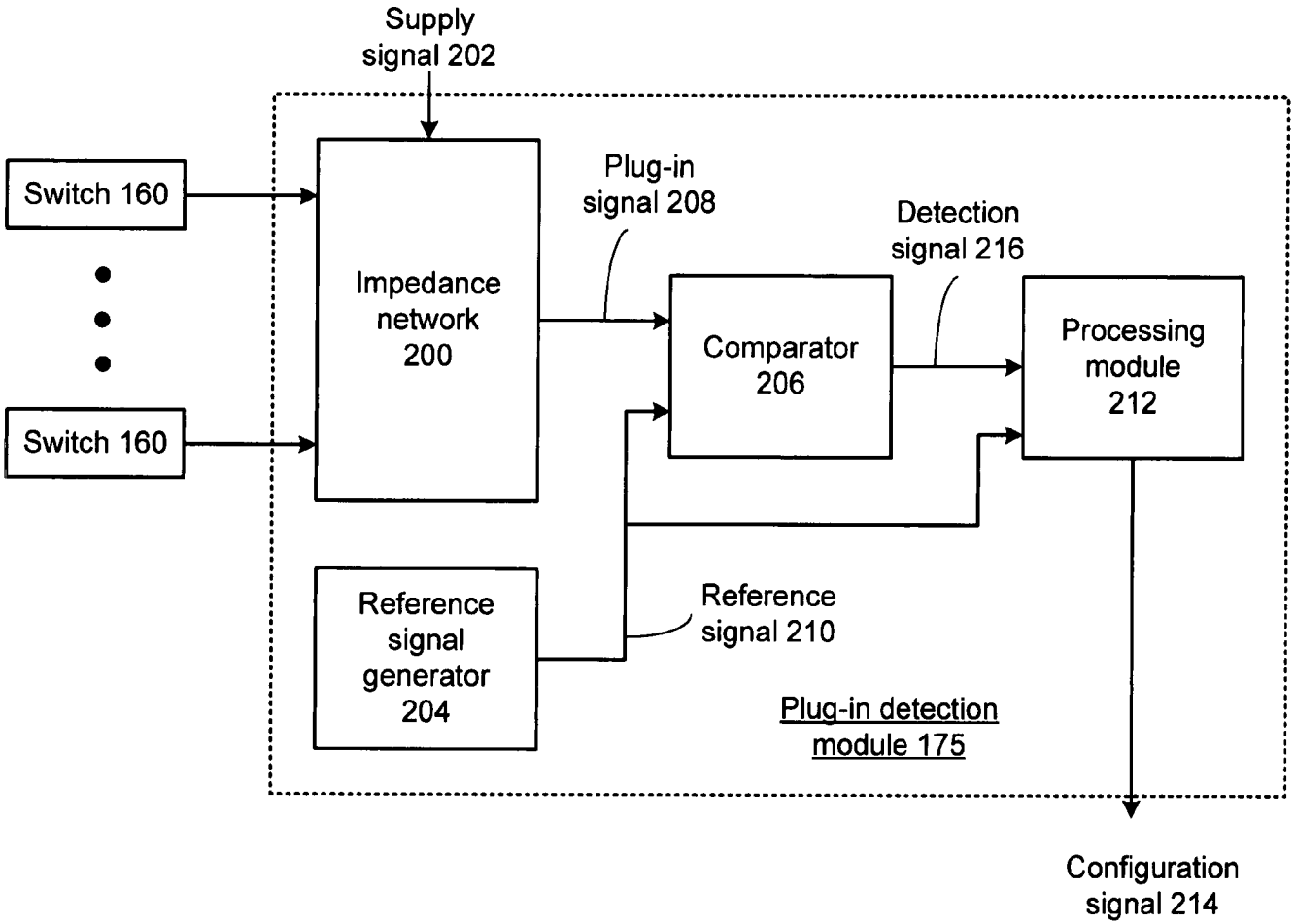
FIG. 3 presents a block diagram representation of a plug-in detection module 175 in accordance with an embodiment of the present invention.

FIG. 3 presents a block diagram representation of a plug-in detection module 175 in accordance with an embodiment of the present invention. In particular, plug-in detection module 175 includes an impedance network 200, operably coupled to the plurality of switches 160 for producing a plug-in signal 208 in response to a supply signal 202. The plug-in signal 208 varies when one of a plurality of plug-in receptors 104 is coupled to a plug connector 102 and when one of the plurality of plug-in receptors 104 is decoupled from a plug connector 102.

A reference signal generator 204 generates a reference signal 210 that has a plurality of reference signal values. Comparator 206 is operably coupled to the plug-in signal 208 and the reference signal 210, and generates a detection signal 216 when the plug-in signal compares favorably to the reference signal. A processing module 212 is operably coupled to the detection signal 216 and the reference signal 210 for detecting which of the plurality of plug-in receptors 104 has a plug connector 102 coupled thereto and for generating a configuration signal 214 that includes this information.

In an embodiment of the present invention, the plurality of plug-in receptors 104 include four or more jacks. In an embodiment of the present invention each plug-in receptor has a dedicated function for coupling to an audio line input, an audio line output, a video input, a video output, a headphone, or a microphone. In an alternative embodiment of the present invention, each plug-in receptor 104 can be used for multiple purposes and may be selectively switched, such as by switch network 170 to couple any one of to an audio line input, an audio line output, a video input, a video output, a headphone, or a microphone.

Figure 4:
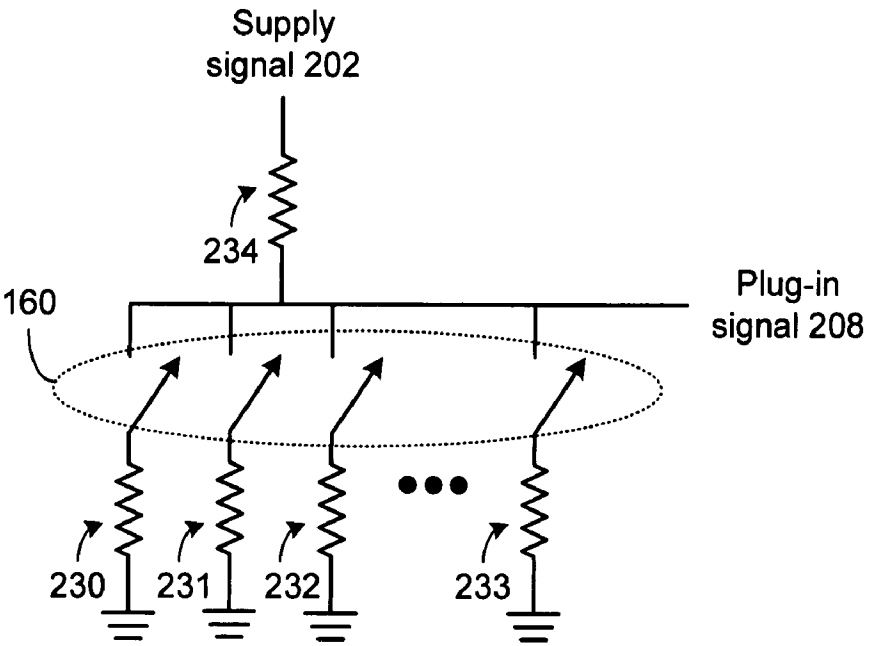
FIG. 4 presents a schematic diagram representation of an impedance network and a plurality of switches in accordance with an embodiment of the present invention.

FIG. 4 presents a schematic diagram representation of an impedance network and a plurality of switches in accordance with an embodiment of the present invention. In particular, impedance network 200 includes a resistive voltage divider implemented with a plurality of high accuracy resistors 230-234, such as 5% resistors, 1% resistors or resistors with more accuracy.

Switches 160 have a first state such as a closed state and a second state, such as an open state—however, the states can be reversed, or other states such as high impedance, low impedance can be used if switches 160 are implemented using electronic components rather than mechanical switching elements.

In an embodiment of the present invention, the values of resistors 230-233 are chosen such that the each possible combination switches 160 between the open and closed states yields a unique resistance on the lower leg of the divider (between the port of plug-in signal 208 and ground) that in turn yields a unique voltage value for plug-in signal 208 based on the voltage divider configuration. The particular configuration of each plug-in receptor 104 (being coupled or decoupled to a plug connector) can therefore be determined from the voltage level of plug-in signal 208.

Considering the example of four plug-in receptors 104 with four corresponding switches 160, and considering the four resistors shown to have a resistance to be defined as presented below:

Resistor 230—$R_0$
Resistor 231—$R_1$
Resistor 232—$R_2$
Resistor 233—$R_3$ The resistance of the lower leg of the circuit has $2^4$=16 possible values based on sixteen possible plug-in receptor conditions—detected based on the unique voltage of plug-in signal 208 that varies based on whether each of the four switches is opened or closed and therefore which of the four plug-in receptors (referenced below as A, B, C and D) have a plug-in connector couple thereto. In particular, these values can be represented as follows:

| Resistance | Plug-in Receptor Condition (Plug-in Receptors Coupled) |
|---|---|
| ∞ (open circuit) | None |
| $R_0$ | A |
| $R_1$ | B |
| $R_2$ | C |
| $R_3$ | D |
| $R_0 \parallel R_1$ | A, B |
| $R_0 \parallel R_2$ | A, C |
| $R_0 \parallel R_3$ | A, D |
| $R_1 \parallel R_2$ | B, C |
| $R_1 \parallel R_3$ | B, D |
| $R_2 \parallel R_3$ | C, D |
| $R_0 \parallel R_1 \parallel R_2$ | A, B, C |
| $R_0 \parallel R_1 \parallel R_3$ | A, B, D |
| $R_0 \parallel R_2 \parallel R_3$ | A, C, D |
| $R_1 \parallel R_2 \parallel R_3$ | B, C, D |
| $R_0 \parallel R_1 \parallel R_2 \parallel R_3$ | A, B, C, D |

In an embodiment of the present invention, the values $R_0$=39.2 kΩ, $R_1$=20 kΩ, $R_2$=110 kΩ and $R_3$=5.1 kΩ can be used for this purpose, however, a large number of other values are likewise possible. Because the lower leg resistances takes on one of sixteen possible values, the resistive voltage divider yields a plug-in signal with one of sixteen possible voltages, based on the particular combination of plug-connectors either coupled to or decoupled from the plug-in receptors 104.

While the resistive voltage divider is shown as driven by a supply voltage 202 and ground, supply voltages, both possible and negative, ground and virtual ground alternating current (AC) and direct current (DC) are likewise possible within the broad scope of the present invention. While resistors are used to implemented impedance network 200 in this configuration, other configurations using other circuit elements having capacitive or inductive impedances are likewise possible.

Figure 5:
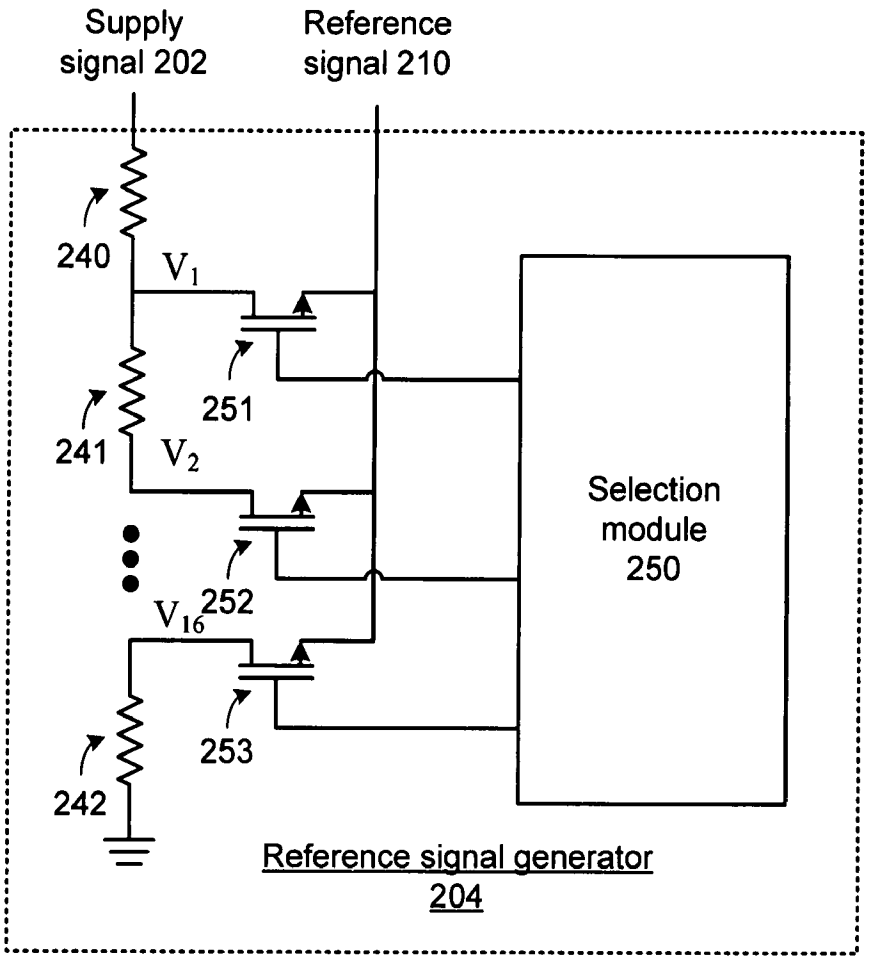
FIG. 5 presents a schematic/block diagram representation of reference signal generator in accordance with an embodiment of the present invention.

FIG. 5 presents a schematic/block diagram representation of reference signal generator in accordance with an embodiment of the present invention. In particular, reference signal generator 204 generates a reference signal value sequence that includes a plurality of reference signal values. In an embodiment of the present invention, the reference signal generator 204 includes a multi-tap resistive voltage divider of resistors 240-242, and selection module 250 for selecting a sequence of voltage divider taps via transistors 251-253.

Considering the example presented in association with FIG. 4, these reference signal values correspond to the $2^n$=16 possible voltages of plug-in signal 208 generated by impedance network 208. In an embodiment of the present invention, the reference signal generator 204 generates the sequence of reference values to scan the possible reference signal values in descending order (assigned a variable in descending order from largest to smallest as $V_1$, $V_2$ . . . $V_{16}$) by turning on transistor 251, while turning off each of the other transistors to generate $V_1$; turning on transistor 252, while turning off each of the other transistors to generate $V_2$; etc.

Processing module 212 detects which of the plurality of plug-in receptors have a plug connector coupled thereto by determining one of the plurality of reference signal values when the plug-in signal 208 compares favorably to the reference signal 210, and by indexing one of the plurality of reference signal values to a look-up table. Following the example described above, the sixteen possible plug-in signal voltages correspond to sixteen possible reference signal values, and therefore to the sixteen possible plug-in receptor conditions as shown in the look-up table below:

| Reference signal value | Plug-in Receptor Condition (Plug-in Receptors Coupled) |
|---|---|
| $V_1$ | None |
| $V_2$ | A |
| $V_3$ | B |
| $V_5$ | C |
| $V_9$ | D |
| $V_4$ | A, B |
| $V_6$ | A, C |
| $V_{10}$ | A, D |
| $V_7$ | B, C |
| $V_{11}$ | B, D |
| $V_{13}$ | C, D |
| $V_8$ | A, B, C |
| $V_{12}$ | A, B, D |
| $V_{14}$ | A, C, D |
| $V_{15}$ | B, C, D |
| $V_{16}$ | A, B, C, D |

In an embodiment of the present invention, each reference signal value is offset slightly below the corresponding plug-in signal value. As the reference signal values are scanned from highest to lowest, each new reference signal value is compared with plug-in signal 208 by comparator 206. When a new reference signal value falls below the plug-in signal value, detection signal 216 is asserted. This indicates that a match has been found.

While a sequence of reference signal values is described above in terms of a descending order, other orders including an ascending order can likewise be used within the broad scope of the present invention. In an embodiment of the present invention, selection module 250 includes a 16-bit shift register; however, other circuits and software are likewise possible to implement within the broad scope of the present invention.

Figure 6:
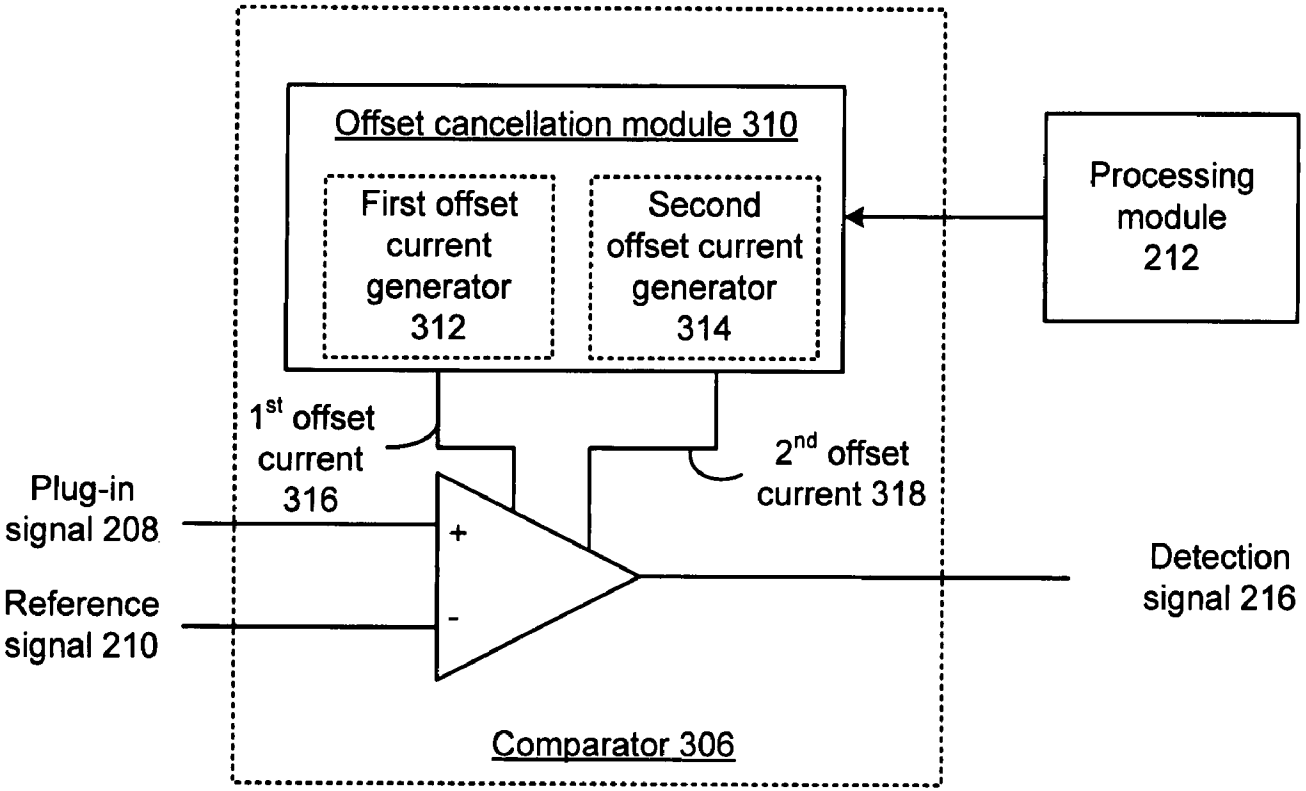
FIG. 6 presents a schematic/block representation of a comparator in accordance with an embodiment of the present invention.

FIG. 6 presents a schematic/block representation of a comparator in accordance with an embodiment of the present invention. In this embodiment, comparator 306 includes an offset cancellation module 310 for automatically balancing a first input current and a second input current of the comparator to enable more accurate measurements. In particular, offset cancellation module 310 includes a first offset current generator 312 for generating a first offset current 316 having a plurality of first offset current values at a first polarity. In addition, cancellation module 310 includes a second offset current generator for generating a second offset current having a plurality of second offset current values of a second polarity. Further, the processing module 212 is operably coupled to the first offset current generator 312 to control the first offset current generator 312 to generate a sequence of first offset current values, and control the first offset current generator 312 to hold the first offset current value when the first input current compares favorably to the second input current. In addition, the processing module 212 is operably coupled to the second offset current generator 314 to control the second offset current generator 314 to generate a sequence of second offset current values, and control the second offset current generator 314 to hold the second offset current value when the first input current compares favorably to the second input current.

In operation, the first offset current generator 312 and second offset current generator 314 each include a plurality of individual current generators, that can be selectively activated to create the first and second offset currents from a superposition of the individual currents. In an embodiment of the present invention, the individual current generators generate currents that are substantially powers of (½) such as 1, ½, ¼, ⅛, 1/16 . . . etc, of a basic offset current value. The first and second offset current values are generated by turning on or off each of these individual current generators to create a total offset current having a particular value. In this fashion, a particular offset current can be selected by scanning a binary sequence of control signals in an order that turn on the individual current generators and generate an order of offset current values that vary in increments or decrements as small as $(½)^n$ of the basic offset current value. The order can be an ascending order or descending order or another order that can be efficiently implemented. If the first and second input currents, corresponding to the positive and negative inputs of the comparator 306, are equalized within the accuracy of +/− the lowest resolution of the offset current generator, the particular offset current that generated this balance can be held to substantially cancel the input offset of comparator 206.

In an embodiment of the present invention, the first offset current 316 and the second offset current 318 are scanned simultaneously so that the second offset current 318 mirrors the first offset current 316, but with opposite polarity. In an embodiment of the present invention, the first offset current 316 begins with a large positive value and second offset current begins with a large negative value. The first offset current 316 is gradually decreased and the second offset current 318 is increased a corresponding amount until the first and second input currents are equalized as discussed above. At this point, the values of the first offset current 316 and the second offset current 318 are held to maintain the balanced state of comparator 206.

Figure 7:
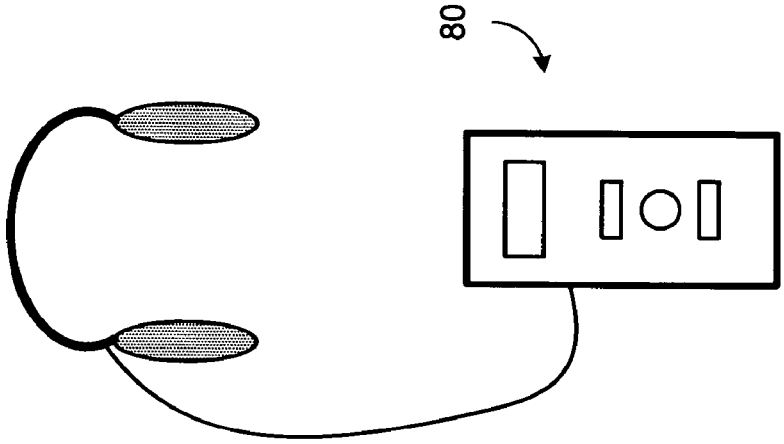
FIG. 7 presents a pictorial view of a handheld audio device in accordance with an embodiment of the present invention.

FIG. 7 presents a pictorial view of a handheld audio device in accordance with an embodiment of the present invention. While the audio input-output module 150 has been described in conjunction with their use in a computer such as computer 100, audio input-output module 150 may likewise be incorporated in a handheld audio device 80 for replaying stored audio files, as well as in voice recorders, cell-phones, and other audio devices, video devices and other electronic devices that process audio signals to provide an audio output. In an embodiment of the present invention, one or more of the circuit modules of audio input-output module 150, plug-in detection module 175, plug-in device detection module 185, impedance network 200, reference signal generator 204, comparator 206 or processing module 212 are implemented as part of an integrated circuit such as a system on a chip integrated circuit.

Figure 8:
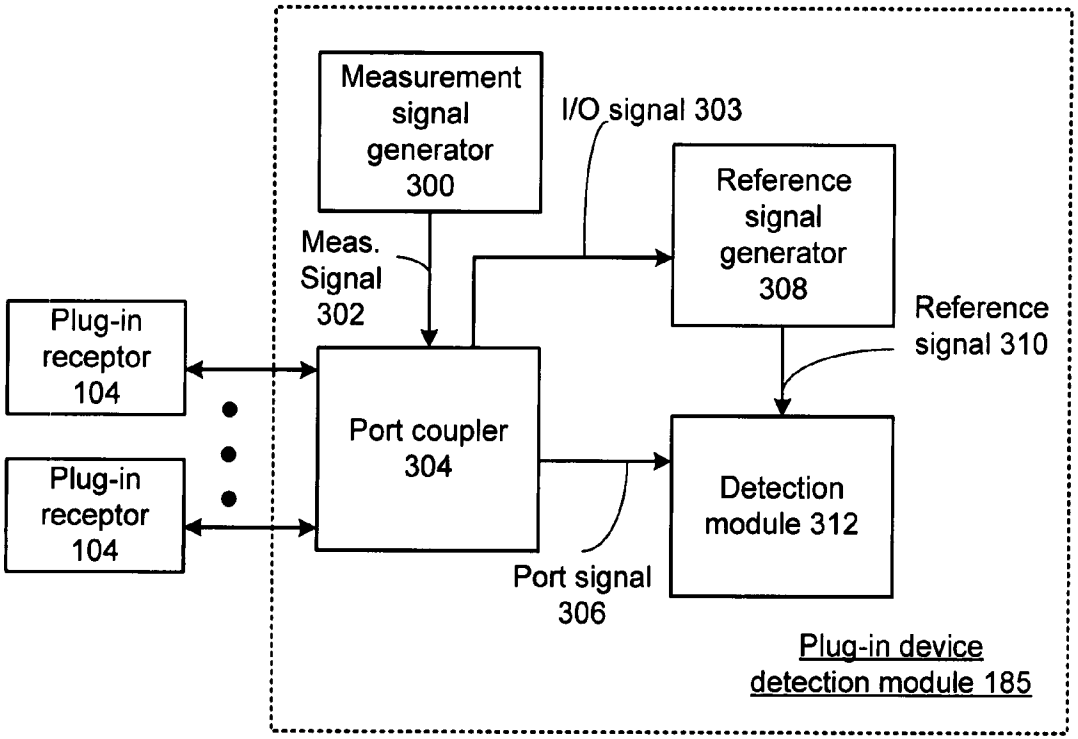
FIG. 8 presents a block diagram representation of a plug-in device detection module in accordance with an embodiment of the present invention.

FIG. 8 presents a block diagram representation of a plug-in device detection module in accordance with an embodiment of the present invention. In particular, a plug-in device detection module 185 includes a measurement signal generator 300 for generating a measurement signal 302. A port coupler 304 is operably coupled to the measurement signal generator 300 for coupling the measurement signal 302 to the selected plug-in receptor 104 for generating an input/output signal 303 and for generating a port signal 306 in response to the measurement signal 302. A reference signal generator 308 generates a reference signal 310 based on the input/output signal 303, wherein the reference signal 310 has a plurality of reference signal values. A detection module 312 is operably coupled to the selected plug-in receptor 104 and the reference signal generator 308 for detecting a plug-in device type of a plug-in device coupled to the selected plug-in receptor 104 based on the reference signal 310 and the port signal 306.

In an embodiment of the present invention, the measurement signal includes a square wave signal of predetermined amplitude that has a frequency. In an embodiment of the present invention a measurement signal frequency in the range of 24 kHz-36 kHz is used to be close to the audio frequency range, but to avoid generating an audio signal. Other frequencies that are DC, sonic, sub-sonic or ultra sonic could likewise be used within the broad scope of the present invention. The port coupler 304 couples the measurement signal 302 to the selected plug-in receptor 104 and to the plug-in device 101 coupled thereto. Port signal 306 is generated that has an amplitude that varies based on the impedance of the plug-in device 101. Reference signal 310 includes a plurality of values that correspond to possible port signals. The impedance of the plug-in device 101, and therefore the device type is determined when a match detection module 312 finds a match between is between a particular reference value of reference signal 310 and the amplitude of port signal 306.

Figure 9:
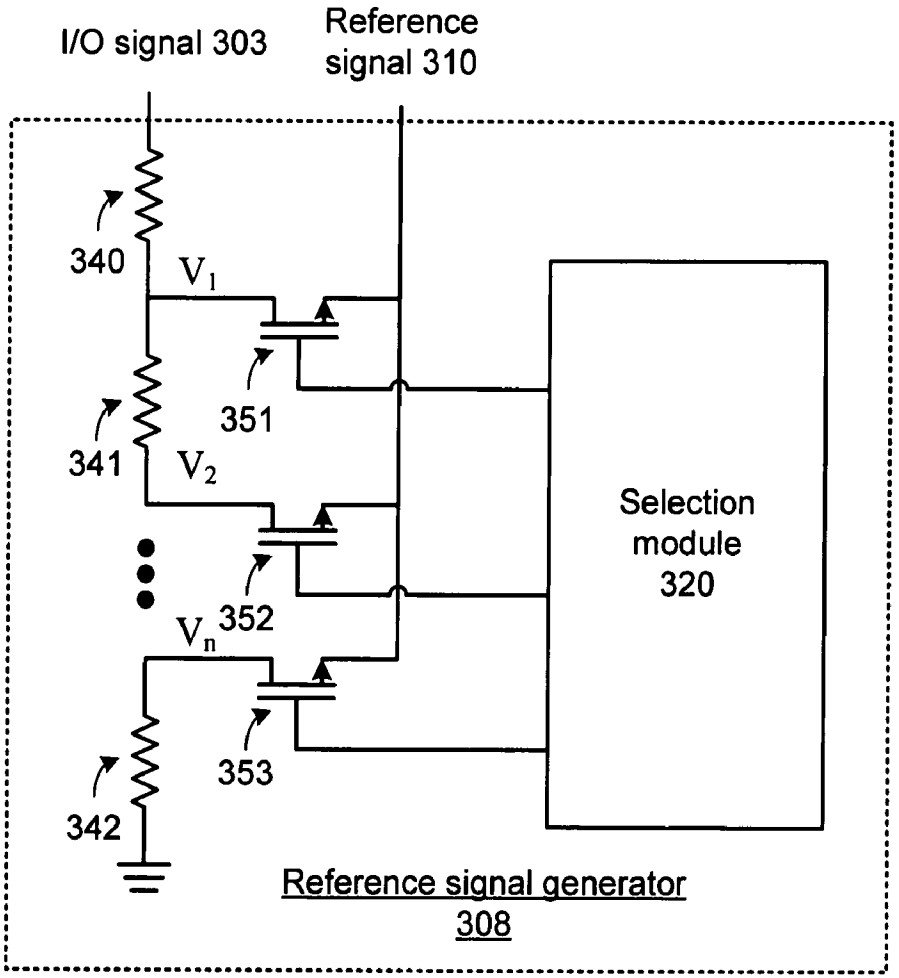
FIG. 9 presents a schematic/block diagram representation of a reference signal generator in accordance with an embodiment of the present invention.

FIG. 9 presents a schematic/block diagram representation of a reference signal generator in accordance with an embodiment of the present invention. In particular, a reference signal generator 308 is presented that, like reference signal generator 204, includes a multi-tap resistive voltage divider that includes resistors 340, 341, 342, . . . for generating the reference signal by dividing the input/output signal. Selection module 320 selectively turns on one of the transistors 351, 352, 353, . . . to select a sequence of taps of the multi-tap voltage divider. This, in turn, generates a sequence of reference signal values that are voltage divided versions of the input/output signal 302 that can be compared to port signal 306 to determine the impedance of the device that is coupled to the selected plug-in receptor 104.

In an embodiment of the present invention, reference signal generator 308 includes a four tap voltage divider for generating reference signal 310 with four reference signal values. Selection module 320 can be implemented using a two-bit counter that scans through four binary values and a demultiplexer that couples a control voltage to turn-on a selected transistor 351, 352, 353 . . . . In an embodiment, the reference signal generator 308 generates a sequence of reference signal values in descending order, however, other orders such as an ascending order, or other order could likewise be used.

Figure 10:
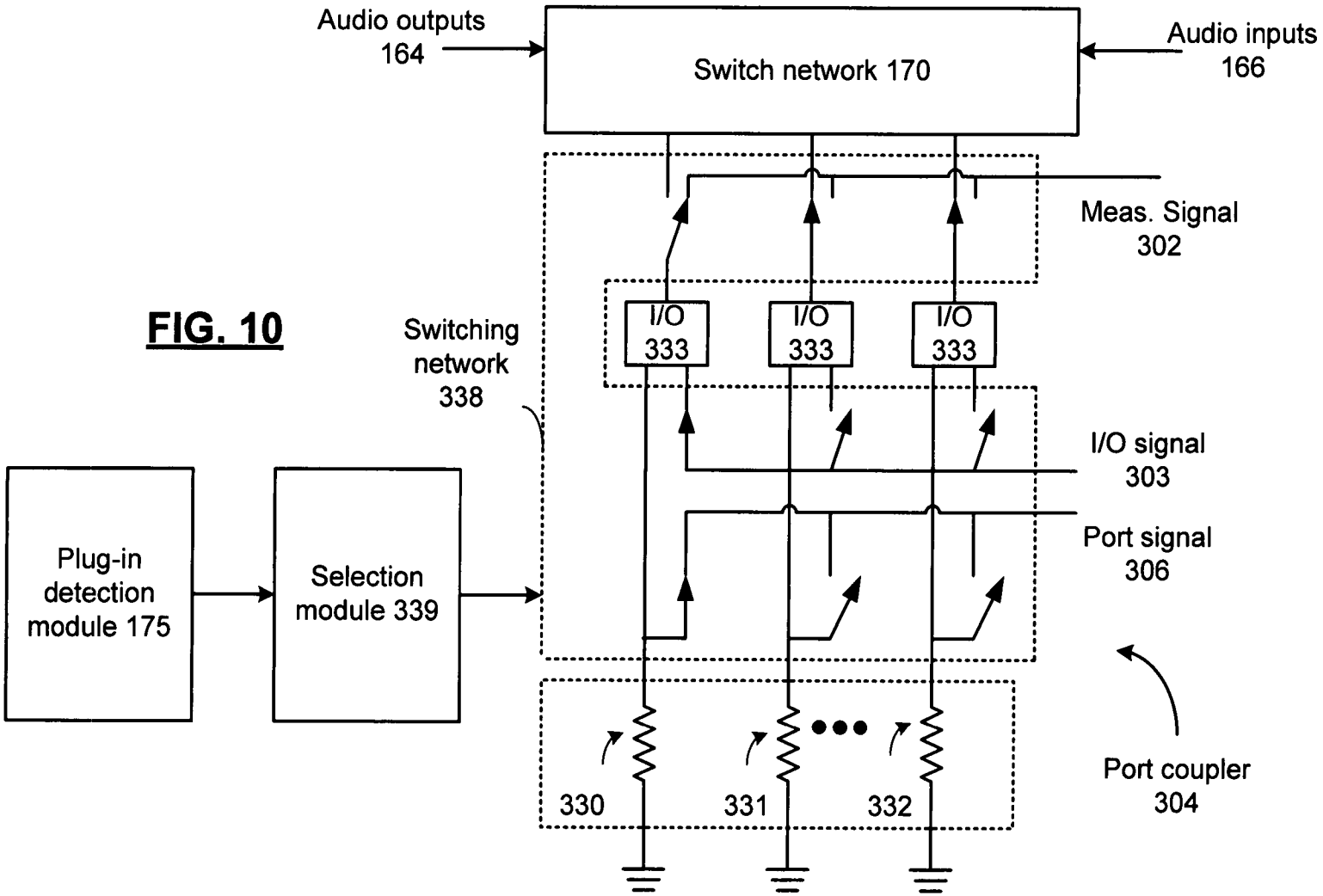
FIG. 10 presents a schematic diagram representation of a port coupler in accordance with an embodiment of the present invention.

FIG. 10 presents a schematic diagram representation of a port coupler in accordance with an embodiment of the present invention. In particular, port coupler 304 includes a switching network 338 for coupling the measurement signal 302 to the selected plug-in receptor 104 through an I/O circuit 333—in response to a plug connector 102 of a plug-in device 101 being coupled to the selected plug-in receptor 104, and for coupling the plug-in receptors 104 to I/O circuits 333 during normal operation, (when they are not being measured). I/O circuits 333 can include line amplifiers for selectively supplying either the measurement signal 302 or output signals such as audio outputs 164 to one or more of the plug-in receptors 104 through switch network 170. I/O circuits 333 can likewise include receivers for coupling an input signal such as audio inputs 166 from a plug-in receptor 104 that is coupled to a microphone or other signal source. In addition, I/O circuits 333, when driven by measurement signal 302, generate an input/output signal 303 in response thereto.

When driven by measurement signal 302, I/O circuits 333 generate port signal 306 by driving a resistive impedance of the particular plug-in device 101 (represented here by resistors 330, 331, 332 . . . ) that is coupled to the selected plug-in receptor 104. Because I/O circuits 333 can be current limited, the magnitude of port signal 306 varies based on the impedance of the plug-in device. In an embodiment of the present invention, I/O circuits 333 include a circuit, such as a current mirror, controlled current generator or other circuit that generates an input/output signal 303 that has a relatively constant amplitude, independent of the impedance of the particular device coupled to the I/O circuit 333.

In an embodiment of the present invention, when a plug-in device 101 is coupled to one of the plug-in receptors 104, plug-in detection module 175 detects a new plug-in receptor condition, and provides a signal to selection module 339 indicating which of the plug-in receptors has been recent coupled. In the case illustrated in FIG. 10, the plug-in device having resistive impedance 330 has been recently coupled to a corresponding plug-in receptor 104. Selection module 339, in turn, provides a control signal to switching network 338 that couples the I/O circuit 333 corresponding to the newly coupled device to the measurement signal 302, switches the I/O signal 303 to be coupled from that particular I/O circuit 333, and couples the output from the selected plug-in receptor (the voltage across resistor 330) as port signal 306. As previously discussed, port signal 306 will have an amplitude that is indicative of the impedance of that device.

In an embodiment of the present invention, selection module 339 includes a demultiplexer for coupling a control voltage to a selected transistor of switching network 338, based on the selected plug-in receptor 104.

Figure 11:
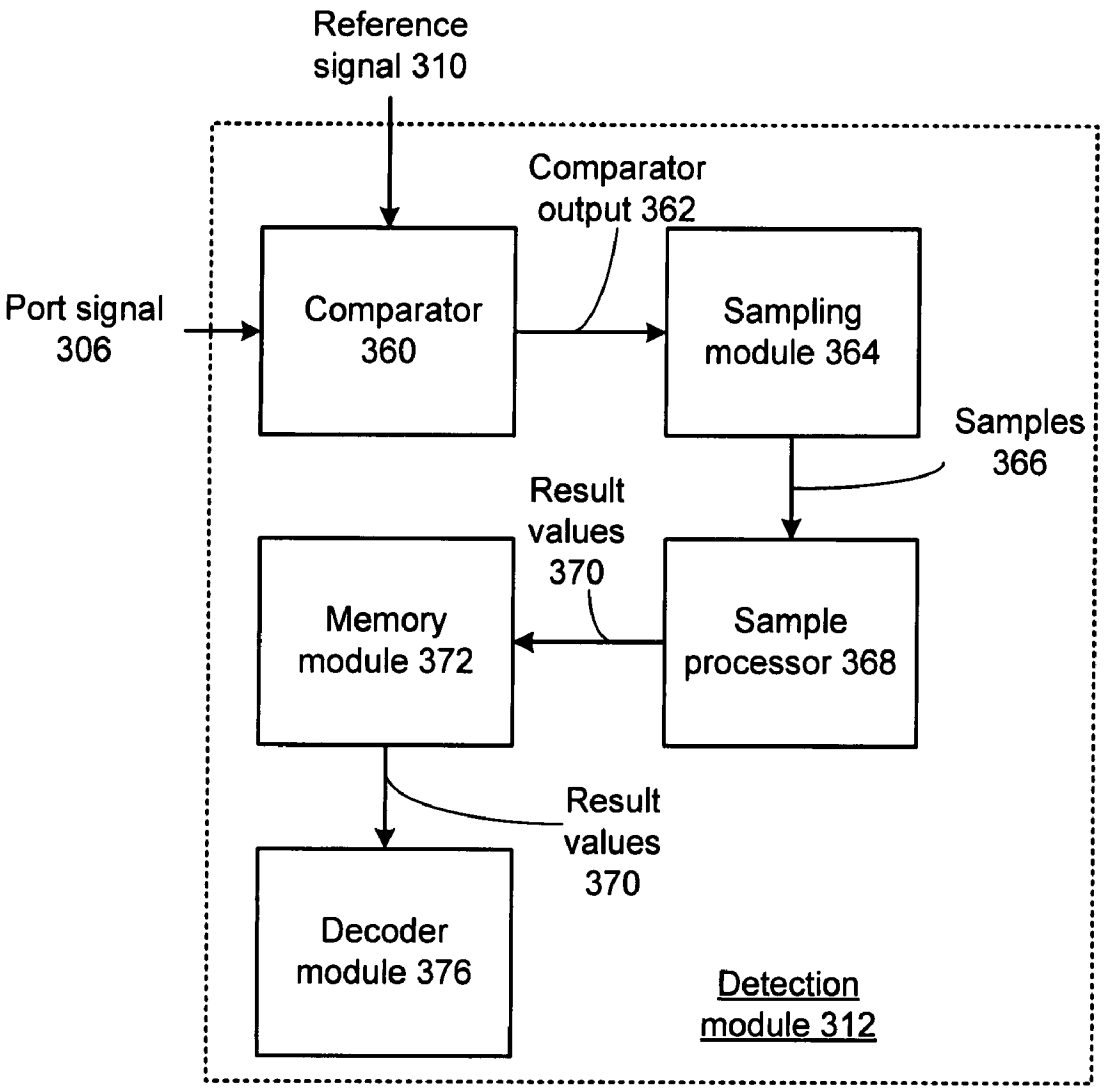
FIG. 11 presents a block diagram representation of a detection module in accordance with an embodiment of the present invention.

FIG. 11 presents a block diagram representation of a detection module in accordance with an embodiment of the present invention. In particular, detection module 312 includes a comparator 360 for comparing the amplitude of the port signal 306 to the amplitude of the reference signal 310 and for generating a comparator output 362. Sampling module 364 generates a plurality of samples 366 of the comparator output 362, each of the plurality of samples 366 having one of: a first state and a second state, such as a high state if the amplitude of the reference signal 310 is greater than the amplitude of the port signal 306, and a low state if the amplitude of the port signal 306 is greater than the amplitude of the reference signal 310.

Detection module 312 further includes a sample processor 368 that is operable to generate a result value 370 that has a first value if a number of the plurality of samples having the first state compares favorably to a first threshold, to generate a result value 370 that has a second value if a number of the plurality of samples having the second state compares favorably to a second threshold, to generate a result value 370 that has a third value if the number of the plurality of samples having the first sate compares unfavorably to the first threshold and if the number of the plurality of samples having the second state compares unfavorably to the second threshold and to storing the result value in memory module 372. Further, sample processor 368 is operable to repeat these steps for each reference signal value and to produce a plurality of stored result values 370.

In accordance with an embodiment of the present invention, sample processor 368 takes a number of samples, such as seven, of comparator output 362 for each reference signal value in the sequence of reference signal values. In an embodiment, first and second thresholds are equal to five, therefore, if five or more of the seven samples of comparator output 362 are high, the result value 370 is stored as a number that represents "high". If five or more samples of the seven samples of comparator output 362 are low, the results value 370 is stored as a number that represents "low". If there neither the first threshold or the second threshold is reached, such as when there are three lows, four highs or four lows and three highs, a result value is stored that represents a middle or indeterminate state. This process is repeated for each reference signal value in the sequence in order to generate a result that indicates the relative value of the impedance.

Considering the embodiment described above whereby four difference reference signal values are generated in descending order, the possible results are as follows, where H represents "high", L represents "low" and M represents an indeterminate value.

| Reference Signal Value | Result Value |
|---|---|
| 1 | H |
| 2 | H |
| 3 | H |
| 4 | H |
| 1 | H |
| 2 | H |
| 3 | H |
| 4 | M |
| 1 | H |
| 2 | H |
| 3 | H |
| 4 | L |
| 1 | H |
| 2 | H |
| 3 | M |
| 4 | L |
| 1 | H |
| 2 | H |
| 3 | L |
| 4 | L |
| 1 | H |
| 2 | M |
| 3 | L |
| 4 | L |
| 1 | H |
| 2 | L |
| 3 | L |
| 4 | L |
| 1 | M |
| 2 | L |
| 3 | L |
| 4 | L |

-continued

| Reference Signal Value | Result Value |
|---|---|
| 1 | L |
| 2 | L |
| 3 | L |
| 4 | L |

Each of these results corresponds to an approximate impedance for the plug-in device 101 coupled to the selected plug-in receptor that can be used to detect the type of device. In particular, decoder module 376 determines a plug-in device type based on a look-up table indexed by the plurality of stored result values and generates a signal or stores a value that represents the device type. For instance, stored results LLLL represent a low impedance value such as 100Ω, that corresponds to the impedance of a particular headphone set. Stored results HHHH represents a high impedance such as 10 kΩ that corresponds to a particular set of speakers.

In this fashion, a number of unique plug-in devices having unique impedances can be determined and used by switch network 170 to couple output signals to output devices, input receivers to input devices, and optionally to adjust the signals levels and current requirements to the particular plug-in device that has been identified.

Figure 12:
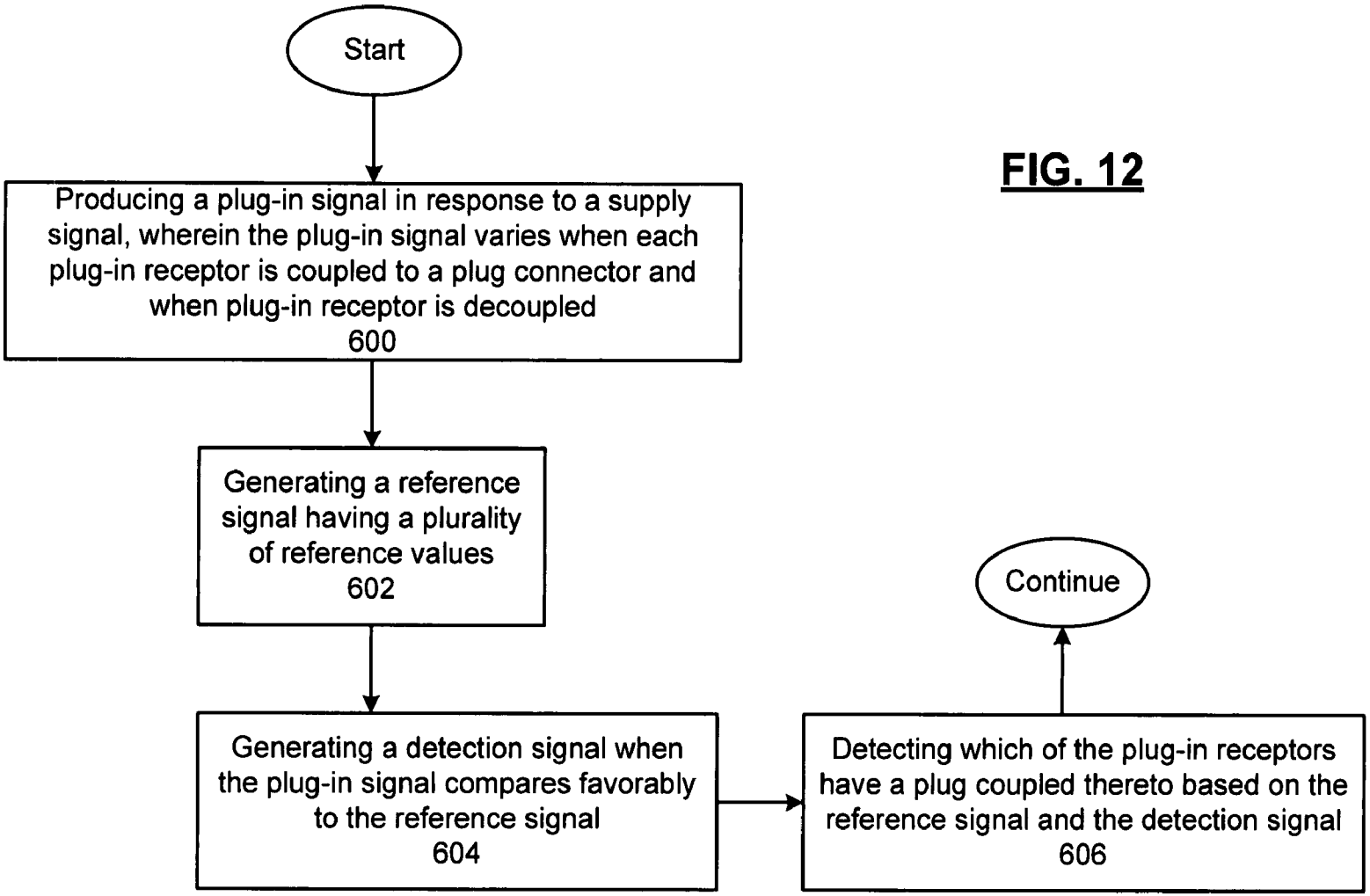
FIG. 12 presents a flowchart representation of a method in accordance with the present invention.

FIG. 12 presents a flowchart representation of a method in accordance with the present invention. In particular, a method is presented for use in conjunction with one or more of the features or functions described in association with FIGS. 1-7. Step 600 includes producing a plug-in signal in response to a supply signal, wherein the plug-in signal varies when each of a plurality of plug-in receptors is coupled to a plug connector and when each of the plurality of plug-in receptors is decoupled. In step 602, a reference signal is generated having a plurality of reference signal values. In step 604, a detection signal is generated when the plug-in signal compares favorably to the reference signal. In step 606, which of the plurality of plug-in receptors have a plug coupled thereto, are detected based on the reference signal and the detection signal.

In an embodiment of the present invention, the plurality of plug-in receptors include four or more jacks for coupling an audio module to at least one of: an audio line input, and audio line output, a video input, a video output, a headphone, and a microphone. In addition, step 604 optionally includes generating a reference signal value sequence that includes the plurality of reference signal values.

Figure 13:
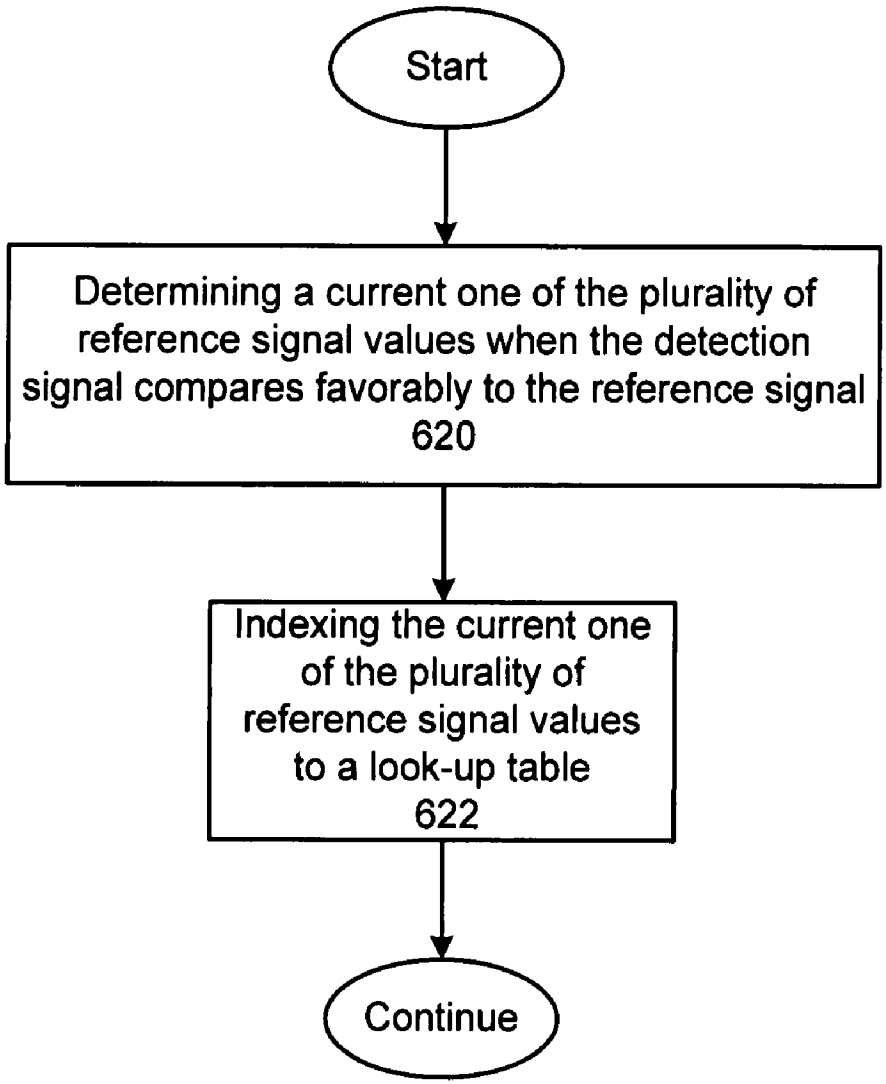
FIG. 13 presents a flowchart representation of a method in accordance with the present invention.

FIG. 13 presents a flowchart representation of a method in accordance with the present invention. In particular, a method is presented for use in conjunction with one or more of the features or functions described in association with FIGS. 1-8. In particular, a method is presented for use in conjunction with Step 606 presented in association with FIG. 8. In step 620 the method determines one of the plurality of reference signal values when the plug-in signal compares favorably to the reference signal. In step 622, one of the plurality of reference signal values is indexed to a look-up table.

Figure 14:
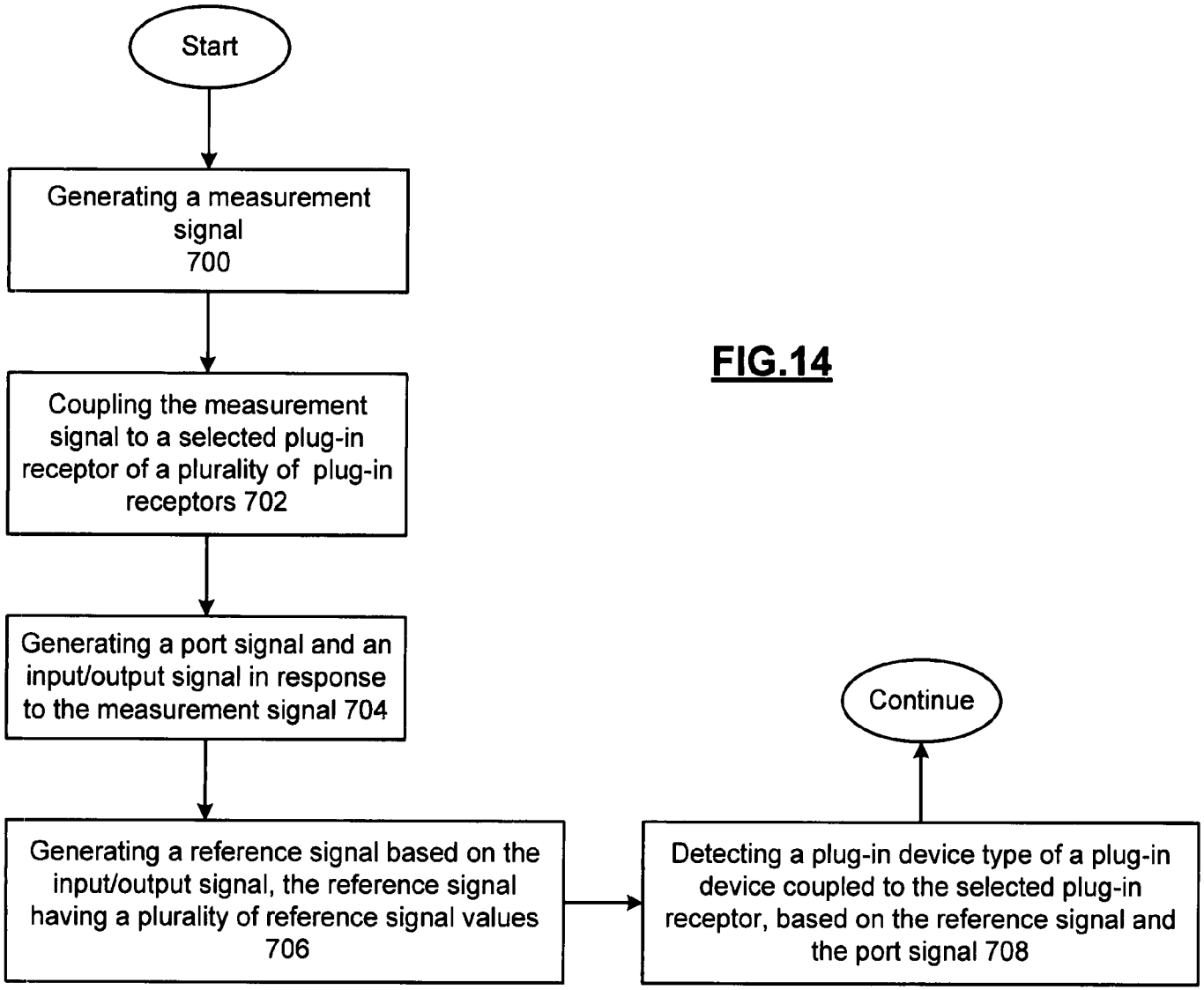
FIG. 14 presents a flowchart representation of a method in accordance with the present invention.

FIG. 14 presents a flowchart representation of a method in accordance with the present invention. A method is presented for use in conjunction with one or more of the features or functions described in association with FIGS. 1-13. In step 700, the method generates a measurement signal. In step 702, the measurement signal is coupled to a selected plug-in receptor of a plurality of plug-in receptors. In step 704, a port signal and an input/output signal is generated in response to the measurement signal. In step 706 a reference signal is generated based on the input/output signal, the reference signal having a plurality of reference signal values. In step 708, a plug-in device type of a plug-in device coupled to the selected plug-in receptor is detected, based on the reference signal and the port signal.

In an embodiment of the present invention, step 706 includes dividing the input/output signal by selecting a sequence of taps of a multi-tap voltage divider to generate a sequence of reference signal values. In an embodiment, the port signal varies based on the impedance of the plug-in device. Further, step 702 optionally includes coupling the measurement signal to the selected plug-in receptor of the plurality of plug-in receptors in response to a plug connector being coupled to the selected plug-in receptor. In an embodiment, the measurement signal includes a square wave signal of predetermined amplitude.

Figure 15:
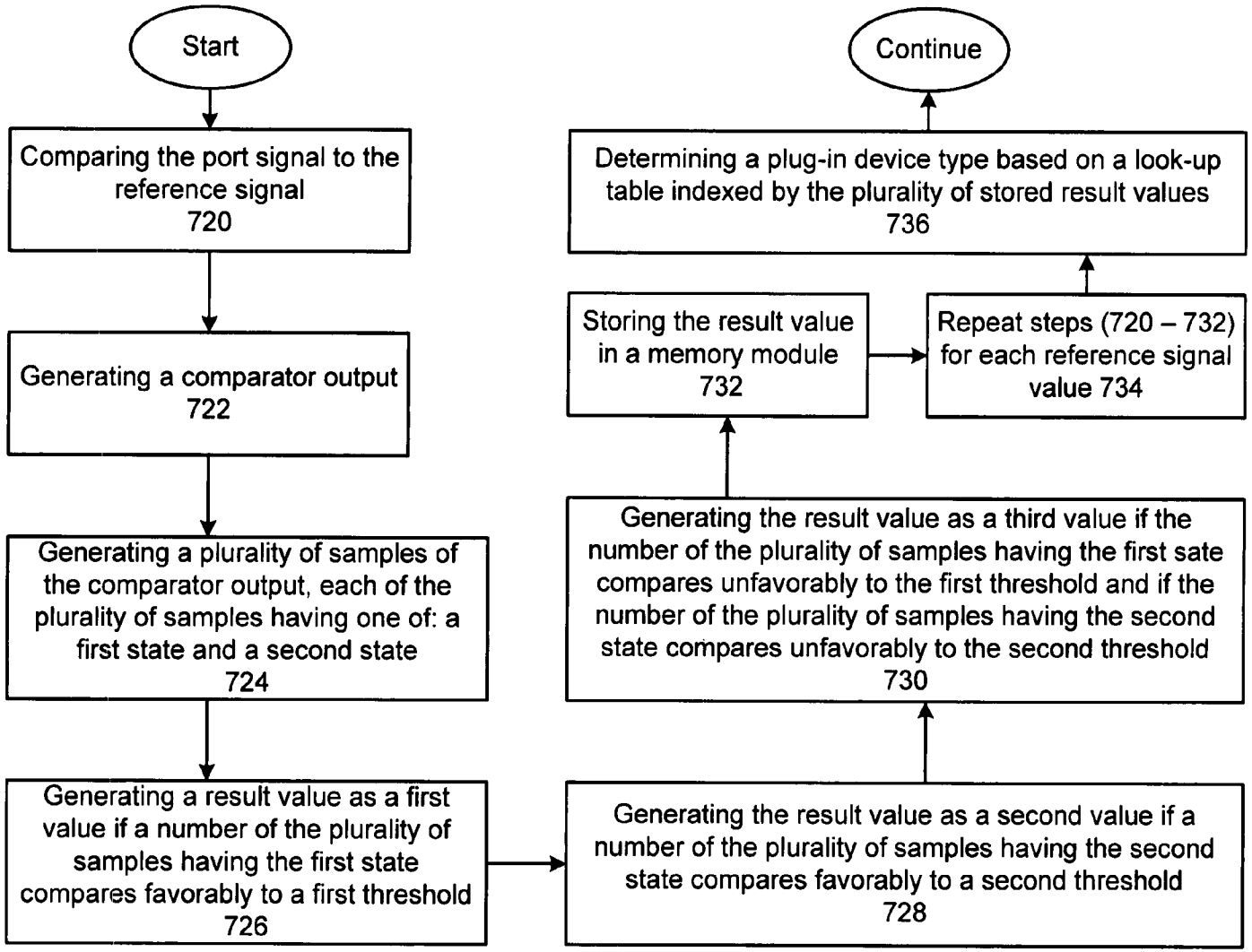
FIG. 15 presents a flowchart representation of a method in accordance with the present invention.

FIG. 15 presents a flowchart representation of a method in accordance with the present invention. A method is presented for use in conjunction with one or more of the features or functions described in association with FIGS. 1-14. In particular, a method is presented for use in implementing step 708 from FIG. 14. In step 720, the port signal is compared to the reference signal. In step 722, a comparator output is generated. In step 724, a plurality of samples of the comparator output are generated, each of the plurality of samples having one of: a first state and a second state. In step 726, a result value is generated as a first value if a number of the plurality of samples having the first state compares favorably to a first threshold. In step 728, the result value is generated as a second value if a number of the plurality of samples having the second state compares favorably to a second threshold. In step 730, the result value is generated as a third value if the number of the plurality of samples having the first sate compares unfavorably to the first threshold and if the number of the plurality of samples having the second state compares unfavorably to the second threshold. In step 732, the result value is stored in a memory module. In step 734, steps 720-732 are repeated for each reference signal value to produce a plurality of stored result values. In step 736 a plug-in device type is determined, based on a look-up table indexed by the plurality of stored result values.

The various modules disclosed herein, including processing module 212 and sample processor 368, can be implemented using hardware or using a microprocessor, microcontroller, digital signal processor, microcomputer, central processing unit, field programmable gate array, programmable logic device, state machine, logic circuitry, analog circuitry, digital circuitry, and/or any device that manipulates signals (analog and/or digital) based on operational instructions that are stored in memory. The memory may be a single memory device or a plurality of memory devices. Such a memory device may be a read-only memory, random access memory, volatile memory, non-volatile memory, static memory, dynamic memory, flash memory, cache memory, and/or any device that stores digital information. Note that when the processing module implements one or more of its functions via a state machine, analog circuitry, digital circuitry, and/or logic circuitry, the memory storing the corresponding operational instructions may be embedded within, or external to, the circuitry comprising the state machine, analog circuitry, digital circuitry, and/or logic circuitry. Further note that, the memory stores, and the processing module executes, operational instructions corresponding to at least some of the steps and/or functions illustrated herein.

As one of ordinary skill in the art will appreciate, the term "substantially" or "approximately", as may be used herein, provides an industry-accepted tolerance to its corresponding term and/or relativity between items. Such an industry-accepted tolerance ranges from less than one percent to twenty percent and corresponds to, but is not limited to, component values, integrated circuit process variations, temperature variations, rise and fall times, and/or thermal noise. Such relativity between items ranges from a difference of a few percent to magnitude differences. As one of ordinary skill in the art will further appreciate, the term "operably coupled", as may be used herein, includes direct coupling and indirect coupling via another component, element, circuit, or module where, for indirect coupling, the intervening component, element, circuit, or module does not modify the information of a signal but may adjust its current level, voltage level, and/or power level. As one of ordinary skill in the art will also appreciate, inferred coupling (i.e., where one element is coupled to another element by inference) includes direct and indirect coupling between two elements in the same manner as "operably coupled". As one of ordinary skill in the art will further appreciate, the term "compares favorably", as may be used herein, indicates that a comparison between two or more elements, items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

In preferred embodiments, the various circuit components are implemented using 0.35 micron or smaller CMOS technology. Provided however that other circuit technologies including other transistor, diode and resistive logic, both integrated or non-integrated, may be used within the broad scope of the present invention. Likewise, various embodiments described herein can also be implemented as software programs running on a computer processor. It should also be noted that the software implementations of the present invention can be stored on a tangible storage medium such as a magnetic or optical disk, read-only memory or random access memory and also be produced as an article of manufacture.

Thus, there has been described herein an apparatus and method, as well as several embodiments including a preferred embodiment, for implementing an audio input-output module and plug-in detection module that can be implemented on an integrated circuit such as a system on a chip integrated circuit. Various embodiments of the present invention herein-described have features that distinguish the present invention from the prior art.

It will be apparent to those skilled in the art that the disclosed invention may be modified in numerous ways and may assume many embodiments other than the preferred forms specifically set out and described above. Accordingly, it is intended by the appended claims to cover all modifications of the invention which fall within the true spirit and scope of the invention.

What is claimed is:

1. An audio input-output module comprising:

a plurality of plug-in receptors;

a plug-in detection module, operably coupled to the plurality of plug-in receptors for detecting that a plug-in connector has been recently coupled to a selected plug-in receptor of the plurality of plug-in receptors;

a plug-in device detection module, operably coupled to the plurality of plug-in receptors and the plug-in detection module, for detecting a plug-in device type of a plug-in device coupled to the one of the plurality of plug-in receptors, wherein the plug-in device detection module includes:

a measurement signal generator for generating a measurement signal;

a port coupler, operably coupled to the measurement signal generator, for coupling the measurement signal to the selected plug-in receptor for generating an input/output signal and for generating a port signal in response to the measurement signal;

a reference signal generator for generating a reference signal based on the input/output signal, the reference signal having a plurality of reference signal values; and a detection module, operably coupled to the selected plug-in receptor and the reference signal generator, for detecting a plug-in device type of a plug-in device coupled to the selected plug-in receptor, based on the reference signal and the port signal; and a switch network, operably coupled to the plug-in device detection module, for selectively coupling to the one of the plurality of plug-in receptors, based on the detected plug-in device type, one of: an audio output and an audio input.

2. The audio input-output module of claim 1 wherein the reference signal generator includes a multi-tap resistive voltage divider for generating the reference signal by dividing the input/output signal.

3. The audio input-output module of claim 2 wherein the reference signal generator generates a sequence of reference signal values.

4. The audio input-output module of claim 3 wherein the reference signal generator includes a selection module for selecting a sequence of taps of the multi-tap voltage divider.

5. The audio input-output module of claim 1 wherein the port signal varies based on the impedance of the plug-in device.

6. The audio input-output module of claim 1 wherein the port coupler includes a switching network for coupling the measurement signal to the selected plug-in receptor in response to a plug connector being coupled to the selected plug-in receptor.

7. The audio input-output module of claim 1 wherein the port coupler includes a resistive voltage divider for generating the port signal based on the measurement signal.

8. The audio input-output module of claim 1 wherein the detection module includes a comparator for comparing the port signal to the reference signal and for generating a comparator output.

9. The audio input-output module of claim 1 wherein the detection module includes a sampling module for generating a plurality of samples of the comparator output, each of the plurality of samples having one of: a first state and a second state.

10. The audio input-output module of claim 1 wherein the detection module includes a sample processor operable to perform:

(a) generate a result value as a first value if a number of the plurality of samples having the first state compares favorably to a first threshold;

(b) generate the result value as a second value if a number of the plurality of samples having the second state compares favorably to a second threshold;

(c) generate the results value as a third value if the number of the plurality of samples having the first state compares unfavorably to the first threshold and if the number of the plurality of samples having the second state compares unfavorably to the second threshold; and (d) storing the result value in a memory module.

11. The audio input-output module of claim 10 wherein the sample processor operable to repeat (a), (b), (c), and (d) for each reference signal value and to produce a plurality of stored result values.

12. The audio input-output module of claim 11 wherein the detection module further includes:

a decoder module, operably coupled to the memory module, for determining a plug-in device type based on a look-up table indexed by the plurality of stored result values.

13. The audio input-output module of claim 1 wherein the measurement signal has a predetermined amplitude.

14. The audio input-output module of claim 1 wherein the measurement signal includes a square wave signal.

15. A plug-in device detection module comprising: a plurality of plug-in receptors; a plug-in detection module, operably coupled to the plurality of plug-in receptors for detecting that a plug-in connector has been recently coupled to a selected plug-in receptor of the plurality of plug-in receptors; a plug-in device detection module, operably coupled to the plurality of plug-in receptors and the plug-in detection module, for detecting a plug-in device type of a plug-in device coupled to the one of the plurality of plug-in receptors, wherein the plug-in device detection module includes: a measurement signal generator for generating a measurement signal; a port coupler, operably coupled to the measurement signal generator, for coupling the measurement signal to a selected plug-in receptor of a plurality of plug-in receptors for generating an input/output signal and for generating a port signal in response to the measurement signal; a reference signal generator for generating a reference signal based on the input/output signal, the reference signal having a plurality of reference signal values; and a detection module, operably coupled to the selected plug-in receptor and the reference signal generator, for detecting a plug-in device type of a plug-in device coupled to the selected plug-in receptor, based on the reference signal and the port signal.

16. The plug-in device detection module of claim 15 wherein the reference signal generator includes a multi-tap resistive voltage divider for generating the reference signal by dividing the input/output signal.

17. The plug-in device detection module of claim 16 wherein the reference signal generator generates a sequence of reference signal values.

18. The plug-in device detection module of claim 17 wherein the reference signal generator generates a sequence of reference signal values by selecting a sequence of taps of the multi-tap voltage divider.

19. The plug-in device detection module of claim 15 wherein the port signal varies based on the impedance of the plug-in device.

20. The plug-in device detection module of claim 15 wherein the port coupler includes a switching network for coupling the measurement signal to the selected plug-in receptor of the plurality of plug-in receptors in response to a plug connector being coupled to the selected plug-in receptor.

21. The plug-in device detection module of claim 15 wherein the port coupler includes a resistive voltage divider for generating the port signal based on the measurement signal.

22. The plug-in device detection module of claim 15 wherein the detection module includes a comparator for comparing the port signal to the reference signal and for generating a comparator output.

23. The plug-in device detection module of claim 15 wherein the detection module includes a sampling module for generating a plurality of samples of the comparator output, each of the plurality of samples having one of: a first state and a second state.

24. The plug-in device detection module of claim 15 wherein the detection module includes a sample processor operable to perform:

(a) generate a result value as a first value if a number of the plurality of samples having the first state compares favorably to a first threshold;

(b) generate the result value as a second value if a number of the plurality of samples having the second state compares favorably to a second threshold;

(c) generate the result value as a third value if the number of the plurality of samples having the first state compares unfavorably to the first threshold and if the number of the plurality of samples having the second state compares unfavorably to the second threshold; and (d) storing the result value in a memory module.

25. The plug-in device detection module of claim 24 wherein the sample processor operable to repeat (a), (b), (c), and (d) for each reference signal value and to produce a plurality of stored result values.

26. The plug-in device detection module of claim 25 wherein the detection module further includes:

a decoder module, operably coupled to the memory module, for determining a plug-in device type based on a look-up table indexed by the plurality of stored result values.

27. The plug-in device detection module of claim 15 wherein the measurement signal has a predetermined amplitude.

28. The plug-in device detection module of claim 15 wherein the measurement signal includes a square wave signal.

29. A method comprising: detecting that a plug-in connector has been recently coupled to a selected plug-in receptor of plurality of plug-in receptors; generating a measurement signal; coupling the measurement signal to a selected plug-in receptor of a plurality of plug-in receptors; generating a port signal and a input/output signal in response to the measurement signal; generating a reference signal based on the input/output signal, the reference signal having a plurality of reference signal values; detecting a plug-in device type of a plug-in device coupled to the selected plug-in receptor, based on the reference signal and the port signal; and selectively coupling to the one of the plurality of plug-in receptors, based on the detected plug-in device type, one of: an audio output and an audio input.

30. The method of claim 29 wherein the step of generating the reference signal includes dividing the input/output signal.

31. The method of claim 30 wherein the step of generating the reference signal includes generating a sequence of reference signal values.

32. The method of claim 31 wherein the step of generating the reference signal includes generating a sequence of reference signal values by selecting a sequence of taps of a multi-tap voltage divider.

33. The method of claim 29 wherein the port signal varies based on the impedance of the plug-in device.

34. The method of claim 29 wherein the step of coupling includes coupling the measurement signal to the selected plug-in receptor of the plurality of plug-in receptors in response to the plug connector being coupled to the selected plug-in receptor.

35. The method of claim 29 wherein the step of detecting includes:

comparing the port signal to the reference signal; and generating a comparator output.

36. The method of claim 29 wherein the step of detecting includes generating a plurality of samples of the comparator output, each of the plurality of samples having one of: a first state and a second state.

37. The method of claim 29 wherein the step of detecting includes:

(a) generating a result value as a first value if a number of the plurality of samples having the first state compares favorably to a first threshold;

(b) generating the result value as a second value if a number of the plurality of samples having the second state compares favorably to a second threshold;

(c) generating the result value as a third value if the number of the plurality of samples having the first state compares unfavorably to the first threshold and if the number of the plurality of samples having the second state compares unfavorably to the second threshold; and (d) storing the result value in a memory module.

38. The method of claim 37 wherein steps (a), (b), (c), and (d) are repeated for each reference signal value to produce a plurality of stored result values.

39. The method of claim 38 wherein the step of detecting includes:

determining a plug-in device type based on a look-up table indexed by the plurality of stored result values.

40. The method of claim 29 wherein the measurement signal has a predetermined amplitude.

41. The method of claim 29 wherein the measurement signal includes a square wave signal.

* * * * *